United States Patent [19]

Thomas

[11] Patent Number: 4,466,203

[45] Date of Patent: Aug. 21, 1984

[54] STAND FOR A HAND HELD HAIR DRYER

[76] Inventor: Charles H. Thomas, 4036 Point Church, Memphis, Tenn. 38127

[21] Appl. No.: 253,032

[22] Filed: Apr. 10, 1981

[51] Int. Cl.[3] ..... A45D 21/00

[52] U.S. Cl. ..... 34/99; 248/229; 248/125

[58] Field of Search ..... 248/229, 172, 121, 122, 248/125, 226.4, 297.3, 106, 107; 297/191, 190, 188, 186; 34/99

[56] References Cited

U.S. PATENT DOCUMENTS

| | | | |
|---|---|---|---|
| 2,110,037 | 3/1938 | De Rosa | 248/229 X |
| 2,470,694 | 5/1949 | Foo | 248/106 |
| 2,597,670 | 5/1952 | Pinto | 248/229 |
| 2,696,963 | 12/1954 | Shepherd | 248/229 |
| 2,841,210 | 7/1958 | Nesselrodt | 297/191 |
| 3,077,613 | 2/1963 | Mayer | 248/226.4 X |
| 3,298,111 | 1/1967 | Parr | 34/99 |
| 3,750,657 | 8/1973 | Lyon | 34/99 X |
| 3,765,633 | 10/1973 | Caudill | 248/229 |
| 3,948,379 | 4/1976 | Warner | 34/99 X |
| 3,972,126 | 8/1976 | De Muro et al. | 34/99 X |
| 3,999,252 | 12/1976 | Bianco | 248/229 |
| 4,278,223 | 7/1981 | Fauteux | 34/99 X |

*Primary Examiner*—William H. Schultz
*Assistant Examiner*—Ramon O. Ramirez
*Attorney, Agent, or Firm*—Walker & McKenzie

[57] ABSTRACT

A stand for converting a hand held hair blow dryer to a chair-type hair drying unit. The stand includes a pair of C-clamps for being attached to the back of a ordinary kitchen chair. A stabilizer bar extends between the two C-clamps. An adjustable neck extends up from the stabilizer bar. The upper end of the neck is provided with a clamp to hold the blow dryer. A flexible hose extends from the blow dryer to a bonnet which fits over the hair of the person sitting in the chair.

1 Claim, 4 Drawing Figures

STAND FOR A HAND HELD HAIR DRYER

BACKGROUND OF THE INVENTION

1. Field of the Invention

The present invention relates to a stand for allowing a hand held hair dryer to be converted to a chair-type hair drying unit.

2. Description of the Prior Art

Various types of prior art hair drying units are well known. Hand held hair drying units (often referred to as "blow dryers") have received great popularity and have significant advantages over other type hair drying units in many specific instances. However, chair-type hair drying units have significant advantages in many instances, but because of cost, are normally found only in commercial establishments. Various portable units consisting of a bonnet, a flexible hose, and a hot air generating unit for resting on a table or the like have been developed in an attempt to provide many of the advantages of chair-type hair drying units at a lower cost. None of the above prior art disclose or suggest the present invention.

SUMMARY OF THE INVENTION

The present invention is directed toward providing means by which a hand held hair drying unit can be converted to a chair-type hair drying unit when desired. The concept of the present invention is to provide a stand for being attached to an ordinary kitchen chair or the like and for securing a hand held hair dryer to the chair.

The stand of the present invention comprises, in general, a first clamp means for being secured to the back of a chair; an upright means having a lower end for being attached to the first clamp means and having a upper end; and a second clamp means for being attached to the upper end of the upright means and for being secured to a hand held hair dryer unit whereby the hand held hair dryer unit is attached to the chair.

DESCRIPTION OF THE PREFERRED EMBODIMENT

Figure 1:
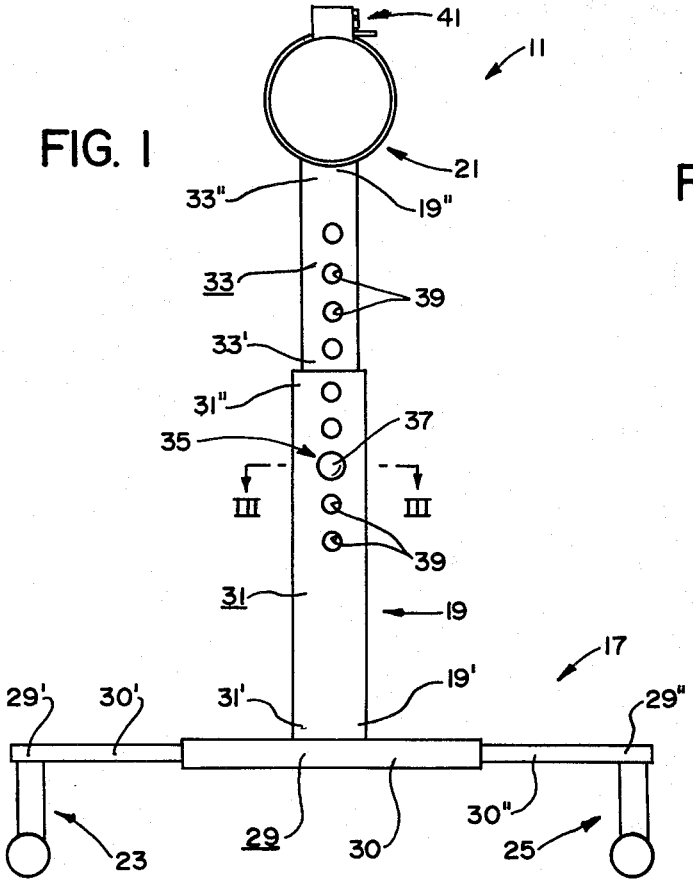
FIG. 1 is a front elevational view of the stand of the present invention.
Figure 2:
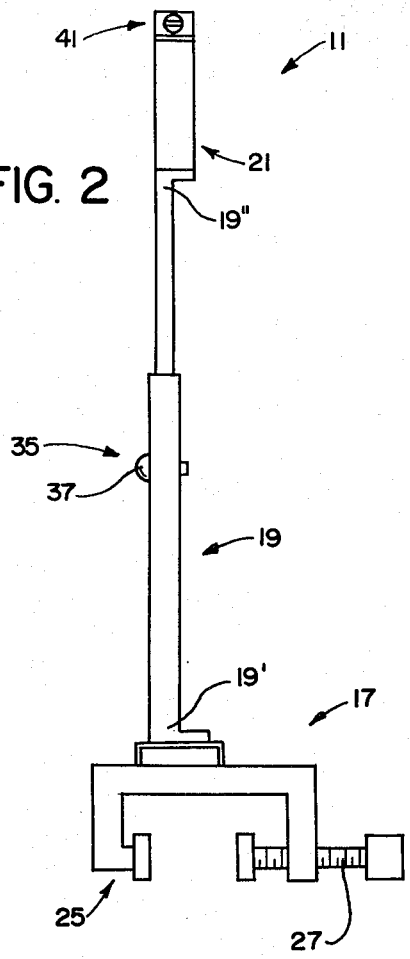
FIG. 2 is a side elevational view thereof.
Figure 3:
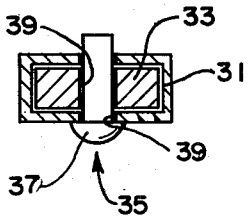
FIG. 3 is a sectional view as taken on line III—III of FIG. 1.
Figure 4:
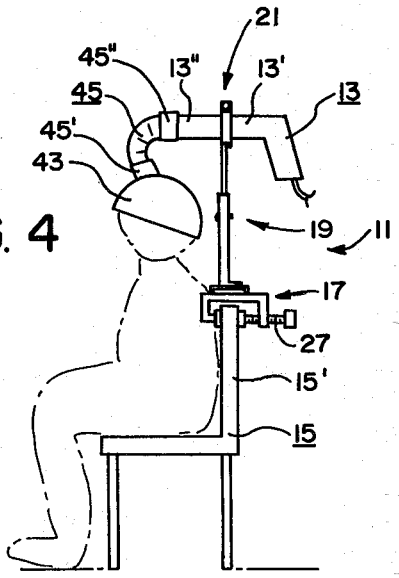
FIG. 4 is a somewhat diagrammatic view showing the stand of the present invention in use.

The stand 11 of the present invention is for use with a standard hand held hair unit 13 commonly referred to as a "blow dryer" and a chair 15 such as an ordinary kitchen chair or the like. The stand 11 comprises, in general, a first clamp means 17 for being secured to the back 15' of the chair 15; neck means 19 having a lower end 19' for being attached to the first clamp means 17 and having an upper end 19''; and a second clamp means 21 for being attached to the upper end 19'' of the neck means and for being secured to the hair drying unit 13.

The first clamp means 17 preferably includes a first C-clamp member 23 for being secured to the back 15' of the chair 15 and a second C-clamp member 25 for being secured to the back 15' of the chair 15. Each C-clamp member 23, 25 preferably includes a screw member 27 for allowing the stand 11 to be selectively and securely attached to the back 15' of the chair 15 in a manner which will now be apparent to those skilled in the art. The stand 11 preferably includes a stabilizer bar 29 having a first end 29' fixedly attached to the first C-clamp member 23 and having a second end 29'' fixedly attached to the second C-clamp member 25. The ends of the stabilizer bar 29 may be attached to the clamp members 23, 25 in any manner apparent to those skilled in the art such as by being welded thereto. The length of the stabilizer bar 29 may be adjustable to allow the distance between the first and second C-clamp members 23, 25 to be varied depending on the width of the specific chair 15. This adjustability may be accomplished in many ways which will now be apparent to those skilled in the art. For example, the stabilizer bar may include a sleeve 30 to which the lower end of the neck means 19 is secured, and a pair of slide member 30', 30'' extending on either side of the sleeve 30 and slidably movable therein. The outer ends of the respective slide members 30', 30'' constitute the first and second ends 29', 29'' respectively of the stabilizer bar thus slidable movement of the slide members 30', 30'' varies the length of the stabilizer bar 29.

The neck means 19 is preferably adjustable in height according to the height of the person sitting in the chair 15. The neck means 19 preferably includes a sleeve member 31 having a first end 31' fixedly attached to the stabilizer bar 29 at a point substantially midway between the first and second ends 29', 29'' of the stabilizer bar 29, and having a second end 31''. The neck means 19 also preferably includes a slide member 33 having a first end 33' for being slidably received within the second end 31'' of the sleeve member 31 and having a second end 33''. The second clamp means 21 is preferably fixedly attached to the second end 33'' of the slide member 33. The slide member 33 is free to move up and down within the sleeve member 31 to adjust the height of the second clamp means 21. The neck means 19 preferably includes lock means 35 for selectively locking the slide member 33 to the sleeve member 31 at any one of a plurality of locations thereon. The lock means 35 may consist merely of a peg member 37 for extending through one of a plurality of spaced apertures 39 in the sides of the sleeve member 31 and slide member 33 whereby the peg member 37 will hold the neck means 19 in any one of a plurality of positions as will now be apparent to those skilled in the art. The first end 31' of the sleeve member 31 may be fixedly attached to the stabilizer bar 29 in any manner now apparent to those skilled in the art such as by being welded thereto.

The second clamp means 21 is fixedly attached to the second end 33' of the slide member 33. The second clamp means 21 is adapted to receive the nose portion 13' of the hair drying unit 13 and hold the hair drying unit 13 secure. The second clamp means 21 is preferably adjustable so that it can be tightened around the nose portion 13' of the hair drying unit 13. The specific instruction of the second clamp means 21 may vary as will now be apparent to those skilled in the art. For example, the second clamp means 21 may consist of a standard hose clamp having a screw type adjustment means 41. The second clamp means 21 may be fixedly attached to the second end 33'' of the slide member 33 in any manner apparent to those skilled in the art such as by being welded thereto.

A durable bonnet means 43 of well known construction is preferably provided for placement over the hair of a person sitting on the chair 15. A flexible hose means 45 is also preferably included. The flexible hose means 45 has a first end 45' for being attached to the bonnet means 43 and having a second end 45" for being removable attached to the exhaust portion 13" of the hair drying unit 13 for distributing hot air from the hair drying unit 13 of the bonnet means 43 to dry the hair of the person wearing the bonnet means 43. The hose means 45 may be attached to the bonnet means 43 and hair drying unit 13 in any manner now apparent to those skilled in the art. For example, the first end 45' of the hose means 45 may be integrally attached to the bonnet means 43 as a one-piece unit and the second end 45" of the hose means 45 may slip over the nose portion 13' of the hair drying unit 13 to form a friction fit with the nose portion 13' over the exhaust portion 13".

The stand 11 is simple to use. When it is desired to use the hair drying unit 13 as a chair mounted unit, the first and second C-clamp members 23, 25 are secured to the back 15' of the chair 15 by way of the screw members 27 in a manner which will now be apparent to those skilled in the art. The nose portion 13' of the hair drying unit 13 is inserted into the second clamp means 21 and the screw-type adjustment means 41 is adjusted to secure the hair drying unit 13 to the stand 11 in a manner which will now be apparent to those skilled in the art. The first end 45' of the hose means 45 is attached to the bonnet means 43. The second end 45" of the hose means 45 is attached to the exhaust portion 13" of the hair drying unit 13. The height of the neck means 19 is adjusted for the height of the particular person whose hair is to be dryed by loosening the screw member 37, raising or lowering the slide member 33 within the sleeve member 31, and then retightening the screw member 37. The bonnet means 43 is placed over the hair of the person whose hair is to be dryed and the hair drying unit 13 is activated in the normal manner. The person's hair will then be dryed while the person remains seated at the chair 15. The majority of the hot air generated by the hair drying unit 13 will be directed onto the hair to be dryed thus resulting in an efficient unit. When it is desired to use the hair drying unit 13 as a hand held unit, the screw-type adjustment means 41 is merely loosened and the hair drying unit 13 is removed from the stand 11 and the hose means 45.

Although the present invention has been described and illustrated with respect to a preferred embodiment thereof and a preferred use therefore, it is not to be so limited since changes and modifications can be made therein which are within the full intended scope of the invention.

I claim:

1. A stand for attaching a standard hand held hair drying unit to the back of a chair, said stand comprising:

(a) first clamp means for being secured to the back of the chair, said first clamp means including a first C-clamp member for being secured to the back of the chair and including a second C-clamp member for being secured to the back of the chair;

(b) a stabilizer bar having a first end attached to said first C-clamp member and having a second end attached to said second C-clamp member;

(c) neck means having a lower end for being attached to said first clamp means and having an upper end, said neck means including a sleeve member having a first end fixedly attached to said stabilizer bar and having a second end, said neck means including a slide member having a first end for being slidably received within said second end of said sleeve member and having a second end;

(d) second clamp means for being attached to said second end of said slide member of said neck means and for being secured to the hair drying unit;

(e) a bonnet means for placement over the hair of a person sitting on the chair; and (f) a flexible hose means having a first end for being attached to said bonnet means and having a second end for being removably attached to the hair drying unit for distributing hot air from the hair drying unit to said bonnet means.

* * * * *